US007969324B2

(12) United States Patent
Chevion et al.

(10) Patent No.: US 7,969,324 B2
(45) Date of Patent: Jun. 28, 2011

(54) OPTIMIZATION OF VEHICULAR TRAFFIC FLOW THROUGH A CONFLICT ZONE

(75) Inventors: Dan Shmuel Chevion, Haifa (IL); Dov Ramm, D.N. Menashe (IL); Yuval Shimony, Haifa (IL); Ron Sivan, Haifa (IL)

(73) Assignee: International Business Machines Corporation, Armonk, NY (US)

( * ) Notice: Subject to any disclaimer, the term of this patent is extended or adjusted under 35 U.S.C. 154(b) by 387 days.

(21) Appl. No.: 12/325,279

(22) Filed: Dec. 1, 2008

(65) Prior Publication Data

US 2010/0134320 A1 Jun. 3, 2010

(51) Int. Cl.
*G08B 1/00* (2006.01)

(52) U.S. Cl. ..... 340/901; 340/905; 340/906; 340/907; 340/916; 340/934; 701/117

(58) Field of Classification Search ..... 340/901, 340/905, 906, 907, 909, 916, 917, 919, 934; 701/117
See application file for complete search history.

(56) References Cited

U.S. PATENT DOCUMENTS 3,593,262 A 7/1971 Spencer
3,872,423 A 3/1975 Yeakley et al.
4,167,785 A * 9/1979 McReynolds et al. ..... 701/118
5,278,554 A 1/1994 Marton
5,357,436 A * 10/1994 Chiu ..... 701/117
5,921,701 A * 7/1999 Clayton ..... 404/1
6,094,616 A 7/2000 Andreas et al.
7,002,486 B2 2/2006 Lawrence
7,092,815 B2 8/2006 Dort
2004/0260455 A1 12/2004 Dort
2007/0038361 A1 2/2007 Yavitz et al.

OTHER PUBLICATIONS

Multiagent Traffic Management: A Reservation-Based Intersection Control Mechanism. Kurt Dresner and Peter Stone. In The Third International Joint Conference on Autonomous Agents and Multiagent Systems, pp. 530-537, New York, New York, USA, Jul. 2004.

* cited by examiner

*Primary Examiner* — Daryl Pope

(57) ABSTRACT

An automatic vehicular traffic flow control technique defines a controlled area, wherein vehicles belonging to different traffic streams contend for occupancy of a conflict zone. A traversal order is computed for the vehicles in the controlled area, wherein the ordered vehicles are assigned to traverse the conflict zone sequentially in accordance with their respective positions in the traversal order. Tracking and tracked vehicles are designated, wherein a respective tracked vehicle immediately precedes each of the tracking vehicles in the traversal order. The tracking vehicles maintain a specified physical relationship with their respective tracked vehicles until the tracked vehicle has traversed the conflict zone. The speed of the traffic streams is increased as necessary so as to achieve a desired throughput through the conflict zone.

29 Claims, 10 Drawing Sheets

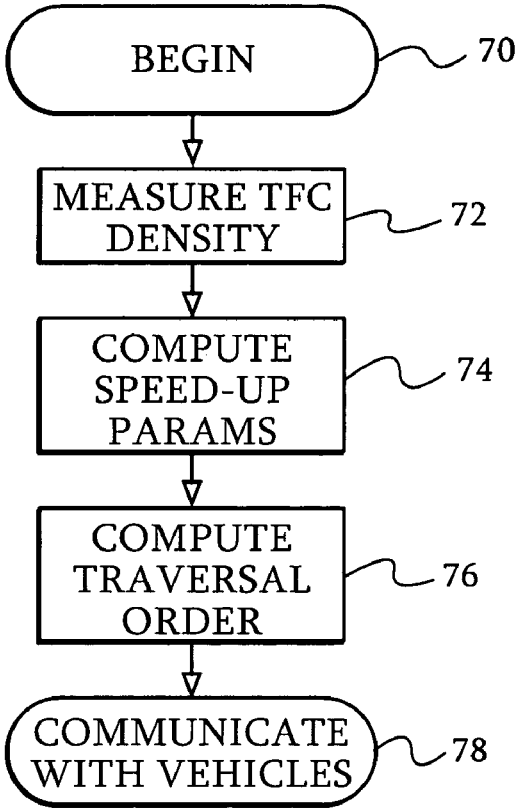
FIG. 8
FIG. 9
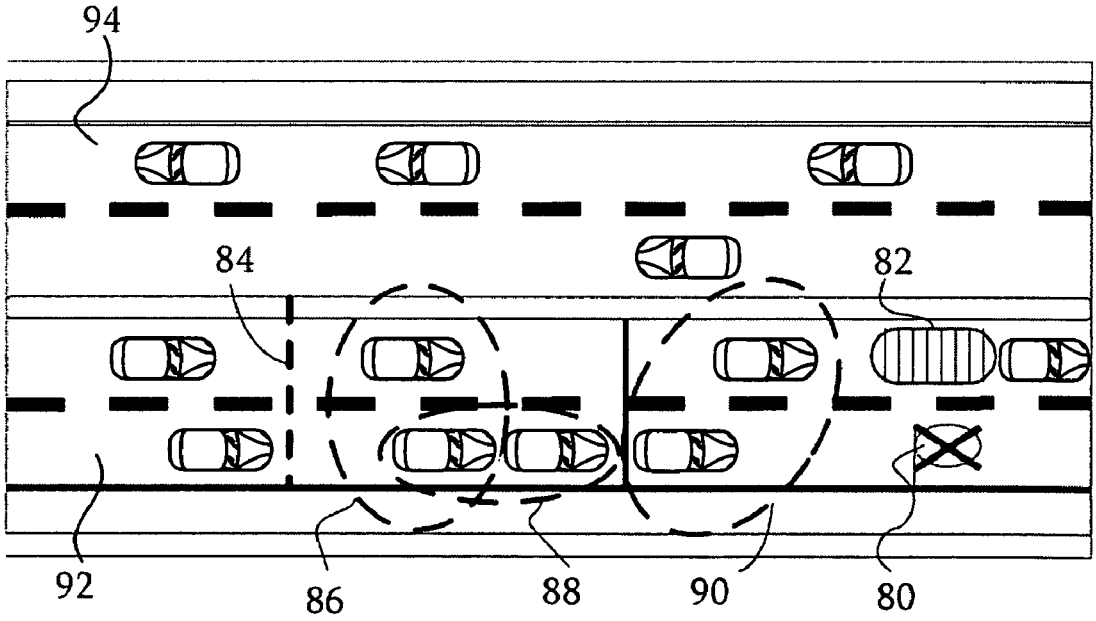

FIG. 10
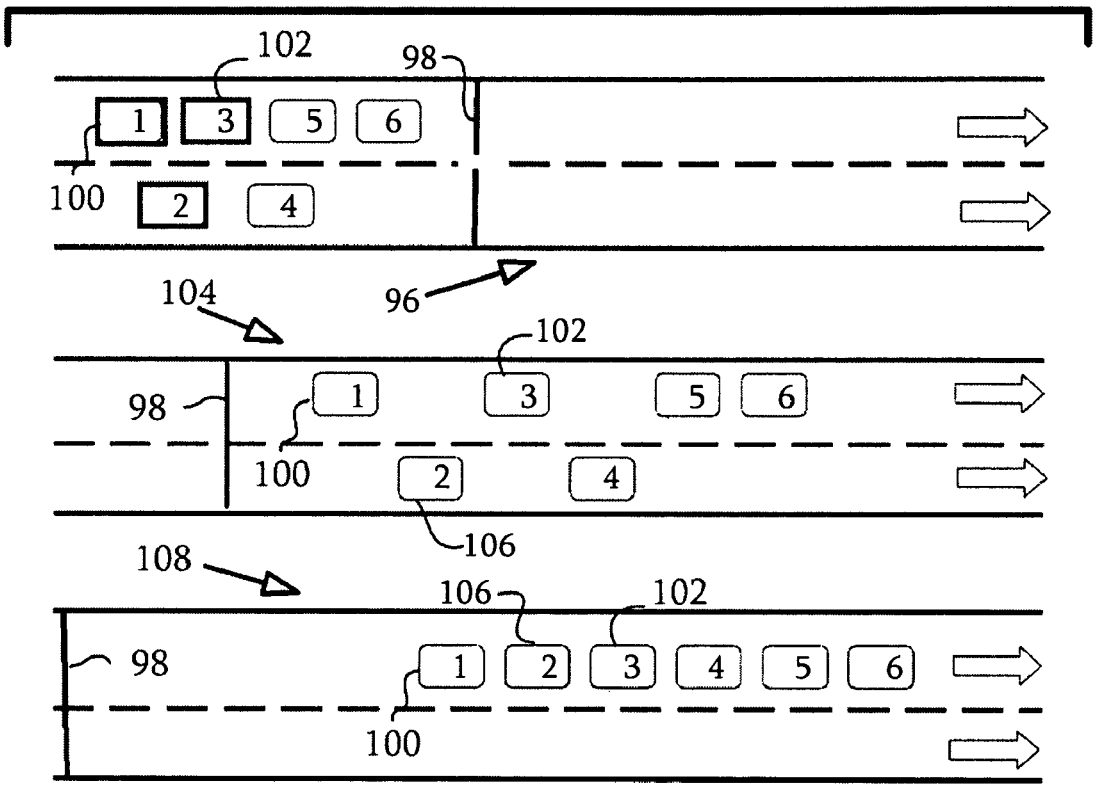
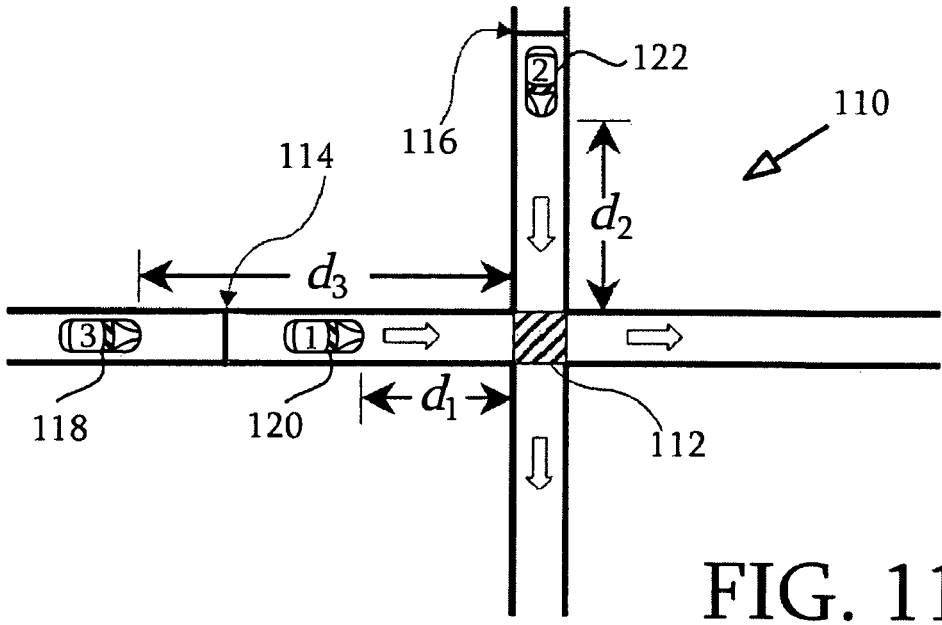
FIG. 11

OPTIMIZATION OF VEHICULAR TRAFFIC FLOW THROUGH A CONFLICT ZONE

BACKGROUND OF THE INVENTION

1. Field of the Invention

This invention relates to vehicular traffic flow control. More particularly, this invention relates to automated control of conflicting streams of vehicular traffic flow that flow through a common zone.

2. Description of the Related Art

Worsening road traffic congestion has handicapped the quality of life, especially in and around cities. This has motivated various attempts at automatic traffic control. Traffic intersections and merge areas are examples of conflict zones, in which forward advance of vehicles is often frustrated by other vehicles vying for the same space. Such conflict zones are often bottlenecks in traffic flow.

Existing traffic control and sequencing devices, for example traffic lights, do not allow maximum traffic flow through conflict zones, due in part to latencies when changing directions of flow.

It has been suggested that the introduction of computers into vehicles and infrastructure to facilitate traffic flow may help overcome woefully slow response time of humans, but is not intended to replace superior capability of humans to perform complex situation analysis and to make moral judgments.

U.S. Patent Application Publication No. 2004/0260455 proposes a traffic spacing system intended to prevent bunching of traffic at low speeds in traffic congestion zones. In one version, an acceleration limiting reception device is placed in vehicles and activated in a congestion zone so as to limit non-negative acceleration of the vehicles.

BRIEF SUMMARY

An embodiment of the invention provides a method of automatic vehicular traffic flow control, which is carried out by defining a controlled area that includes a conflict zone having a plurality of vehicular traffic streams passing therethrough in different directions and entering the controlled area at respective initial speeds. Vehicles belonging to different ones of the vehicular traffic streams contend for occupancy of the conflict zone. The method is further carried out by interleaving the vehicular traffic streams at the conflict zone under automatic control while varying respective zone speeds of the vehicular traffic streams, such that the vehicular traffic streams freely flow through the conflict zone without traffic backup, wherein the zone speeds are not less than the respective initial speeds. Typically, the vehicles are caused to accelerate as they approach the conflict zone in order to increase throughput through the zone.

Another embodiment of the invention provides a method of automatic vehicular traffic flow control, which is carried out by defining a controlled area that includes a conflict zone having a plurality of vehicular traffic streams passing therethrough wherein vehicles belonging to different ones of the streams contend for occupancy of the conflict zone, computing a traversal order for the vehicles that are located within the controlled area to define ordered vehicles. The ordered vehicles are assigned to traverse the conflict zone sequentially in accordance with their respective positions in the traversal order, The method is further carried out by designating, among the ordered vehicles, tracking vehicles and a respective tracked vehicle for each of the tracking vehicles, wherein the respective tracked vehicle immediately precedes each of the tracking vehicles in the traversal order, and wherein at least a portion of the tracking vehicles belong to one stream and their respective tracked vehicles belong to the another stream, and causing each of the tracking vehicles to maintain a specified physical relationship with the respective tracked vehicle thereof, until the respective tracked vehicle has traversed the conflict zone.

The traversal order is a total ordering, which defines unambiguously, for any pair of the vehicles, which of the pair is to be first in traversing the conflict zone. The traversal order may be established according to respective arrival times of the vehicles in the controlled area.

One aspect of the method includes preventing the tracking vehicles from entering the conflict zone until their respective tracked vehicles have crossed the conflict zone.

According to aspect of the method, the specified physical relationship is a function of distances to the conflict zone of the tracking vehicles and their respective tracked vehicles.

According to a further aspect of the method, the function is a difference between a distance to the conflict zone of the tracking vehicles and a distance to the conflict zone of their respective tracked vehicles.

According to yet another aspect of the method, the tracking vehicles and their respective tracked vehicles approach the conflict zone from different directions.

According to still another aspect of the method, computing a traversal order includes disseminating the traversal order to the tracking vehicles.

An additional aspect of the method includes maintaining a constant speed of the streams through the conflict zone.

One aspect of the method includes adjusting boundaries of the controlled area responsively to a momentary traffic density in the streams.

Other embodiments of the invention provide computer software product and apparatus for carrying out the above-described methods.

BRIEF DESCRIPTION OF THE SEVERAL VIEWS OF THE DRAWINGS

For a better understanding of the present invention, reference is made to the detailed description of the invention, by way of example, which is to be read in conjunction with the following drawings, wherein like elements are given like reference numerals, and wherein:

FIG. 8 is a flow chart of a method of automatic traffic control employing speed-up, in accordance with a disclosed embodiment of the invention;

FIG. 9 diagrammatically illustrates automatic traffic control in a multi-lane highway in which some of the lanes are blocked, in accordance with a disclosed embodiment of the invention;

FIG. 10 diagrammatically shows a sequence of vehicular realignments that occur in the blocked multi-lane highway shown in FIG. 9, in accordance with a disclosed embodiment of the invention;

FIG. 11 diagrammatically illustrates automatic traffic control in an intersection, in accordance with a disclosed embodiment of the invention;

DETAILED DESCRIPTION

Figure 1:
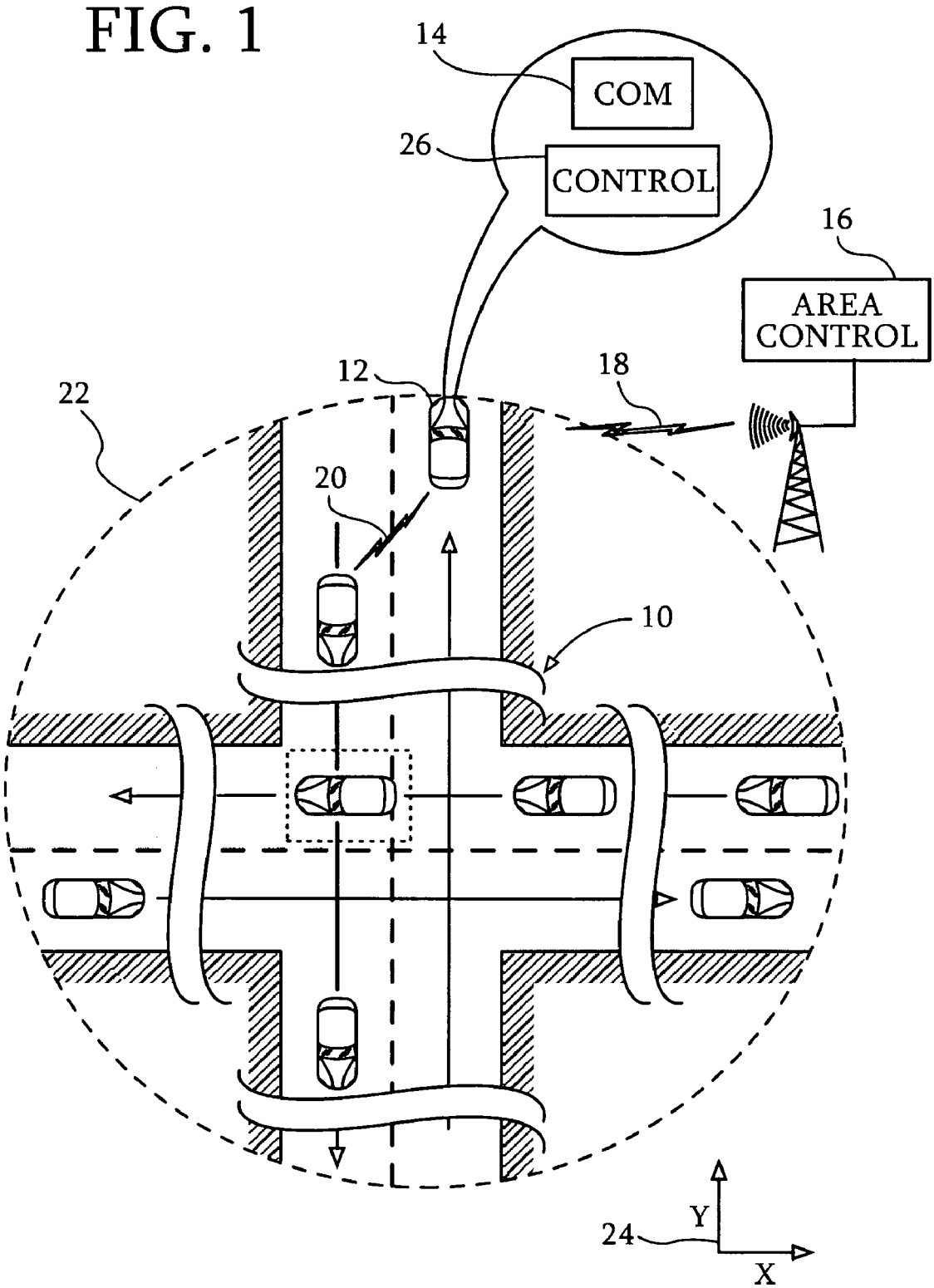
FIG. 1 is a pictorial representation of an automated control system for a traffic intersection in accordance with a disclosed embodiment of the invention.

In the following description, numerous specific details are set forth in order to provide a thorough understanding of the various principles of the present invention. It will be apparent to one skilled in the art, however, that not all these details are necessarily always needed for practicing the present invention. In this instance, well-known circuits, control logic, and the details of computer program instructions for conventional algorithms and processes have not been shown in detail in order not to obscure the general concepts unnecessarily.

As will be appreciated by one skilled in the art, the present invention may be embodied as a system, method or computer program product. Accordingly, the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present invention may take the form of a computer program product embodied in any tangible medium of expression having computer usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CDROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on a user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Embodiments of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means, which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions, which execute on the computer or other programmable apparatus provide processes for implementing the functions/acts specified in the flowchart and/or block diagram block or blocks.

Overview.

Contention in vehicular traffic occurs in various types of shared road stretches that require streams moving in different directions or different lanes to occupy the same zone or lane of a stretch. Such stretches are referred to herein as "conflict zones", examples of which are noted above. Encountering them is common while driving in everyday traffic. Essentially, a conflict zone is established when a plurality of vehicular traffic streams pass through a common area that is constrained so as to require members of different streams to cross the same zone. The members thus contend for occupancy of the zone. It is observed that conflict zones are the cause for many, perhaps most traffic delays: vehicles must slow and often stop completely when negotiating passage through a conflict zone. They are also the sites of 25%-45% of all traffic accidents.

Some embodiments of the present invention provide methods and systems to coordinate traffic in the vicinity of conflict zones, thus reducing delays and avoiding jams. It is assumed that vehicles are provided with vehicle-to-vehicle and vehicle-to-infrastructure communication facilities. Operational vehicles in a factory yard, and cabs for self-driving within an airport, are typical examples of controlled environments suitable for application of the principles of the invention. However the invention is not limited to such environments, and may be practiced in other environments, provided only that the vehicles are provided with the above-noted communications facilities, and that human drivers at least partially surrender control to an automated control system.

One aspect of the invention enables synchronization of traffic flows arriving at a conflict zone from different directions, such as at an intersection. When passing through the conflict zone, while maintaining normal speed, vehicles moving in one direction are interleaved in gaps between vehicles traveling in another direction. Such interleaving can substantially increase the throughput of the intersection.

Turning now to the drawings, reference is initially made to FIG. 1, which is a pictorial representation of an automated control system for a traffic intersection 10, in accordance with a disclosed embodiment of the invention. Vehicles entering and leaving the intersection 10, e.g., representative vehicle 12, are required to be equipped with communications module 14 (COM), having the capability of vehicle-to-vehicle communication, and communication with an area control facility 16, represented by signals 18, 20. The area control facility 16 has jurisdiction over a region 22 that includes the intersection 10 and its environs, as represented by a broken circle that delineates the region's boundary. In FIG. 1, the boundary is symmetric, but this need not be the case. For example, when the roads leading to the conflict zone have different capacities, the region 22 may be elliptical or even irregular when traffic density varies in different paths leading through the conflict zone.

The communications module 14 iteratively emits signals that include a signature uniquely identifying the vehicle 12 within the area controlled by the area control facility 16. The signals (and similar signals emitted by other vehicles) provide momentary information enabling the vehicle 12 and the other vehicles to be located on some reference coordinate system 24, and hence with respect to one another. Thus, in some embodiments, vehicles may incorporate range-finding devices, or distance detection devices that reference some fixed location, including satellite-dependent devices, e.g., global positioning system equipment. The devices may be installed in the vehicles in various combinations and can be actuated according to the local traffic situation and the topography of a particular conflict zone. Many such navigation techniques are known in the art, and have sufficient spatio-temporal resolution for purposes of vehicular traffic control. In any case, signals are detected by the area control facility 16 and by other vehicles at least within the region 22. It is assumed that every vehicle volunteers the above-mentioned information to any requesting vehicle and to the area control facility 16. In some embodiments, the information conveyed in the signals 18, 20 may be more extensive, including, for example, speed and acceleration data.

The vehicle 12 is provided with a vehicular control module 26, which is responsive to signals from the communications module 14. In one mode of operation, the communications module 14 receives supervisory instructions from the area control facility 16. The communications module 14 interprets and prioritizes the instructions, together with information received from other vehicles. Using the current information, the communications module 14 formulates and communicates signals to the vehicular control module 26. The vehicular control module 26 regulates such vehicular functions as acceleration, and braking. It may incorporate a collision avoidance subsystem (not shown), which could override the instructions from the communications module 14 under some circumstances. Furthermore, it is possible for the driver to override the control module, particularly during braking.

Processing of the signals 18, 20 by the area control facility 16 results in a dynamic determination of the state of traffic in the region 22. This information is coordinated among the vehicles in the area. For example, it enables the vehicle 12 to assume the role of tracking another vehicle in the local area, i.e., maintain a constant distance from the other vehicle and itself to be tracked by another vehicle. One tracking arrangement, which could be adapted to this purpose by those skilled in the art, is disclosed in copending, commonly assigned application Ser. No. 11/776570.

Ordinary Tracking.

Tracking a preceding vehicle, referred to herein as "ordinary tracking", is used to maintain a safe distance between successive vehicles moving in the same direction and in the same lane. A tracking vehicle behaves conventionally, i.e., essentially as it would under human control, when no other vehicle is proximately ahead. Upon approaching another vehicle from behind, a vehicle operating under ordinary tracking is automatically constrained to move no faster than the vehicle it is approaching and tracking. Moreover, the distance between it and the tracked vehicle is never allowed to drop below a minimum which depends on the speed at which the vehicles are moving: the faster the vehicles go, the bigger this minimum distance will be. The minimum distance is calculated to be sufficient to avoid collision even if the lead vehicle brakes for an emergency. Since latencies due to communications are very short, the tracking vehicle applies its brakes practically simultaneously with the lead vehicle. Inter-vehicle gaps are set principally to compensate for anticipated differences in braking distance between the two vehicles, e.g., due to differences in tire wear, as well as for any delay in communication. This distance will still be smaller than inter-vehicle gaps when vehicles are controlled by human drivers, as the latter gaps must accommodate, in addition to the above, the time it takes a human driver to detect the need to stop and then physically apply the brakes.

In some embodiments, when a human operator does not fully surrender control to an automatic tracking system, speed constraints for ordinary tracking may be achieved through a continuous and gradual change in the effect the accelerator pedal has on the tracking vehicle. This allows for some degree of continued human operator control over the vehicle in spite of the imposed speed limitation. Automatic driving aids, such as advanced cruise control (ACC) may be incorporated in the vehicular control module 26 as an adjunct to determination of vehicular location and speed obtained by processing the signals 18, 20.

Generalized Tracking.

Where inter-vehicle communication is available, and even more so when an ad hoc data network comprising multiple vehicles and, optionally, the area control facility 16 is provided, a vehicle may maintain a specific positional relationship with any other vehicle with which it can communicate. Whether the other vehicle is in front, nearby or elsewhere in the region 22 is immaterial. Such tracking is referred to herein as "generalized tracking". Control arrangements for such networks are known and can be adapted to the particular application of the principles of the invention as disclosed herein.

The specified relationship is chosen based on the particular needs of the situation. For example, two vehicles approaching the same conflict zone may maintain the difference of their distance to that conflict zone constant, so that regardless of how fast (or slow) the lead vehicle chooses to go, the tracking vehicle will reach the conflict zone only after the lead vehicle has cleared it. This is a generalization of the intuitive notion of normal inter-vehicle distance when the two vehicles happen to travel in the same lane; hence the term "generalized tracking".

If vehicle A is following vehicle B using ordinary tracking, it is said to be "physically tracking" vehicle B. If, instead, vehicle A is tracking vehicle C that is not physically in front of vehicle A in the generalized manner just described, vehicle A is said to be "logically tracking" vehicle C.

Although a vehicle can physically track only one other vehicle, there is no limit to the number of vehicles it can track logically. In the case multiple vehicle tracking, each of the tracked vehicles imposes a constraint on the position and speed of the tracking vehicle. The tracking vehicle selects the most restrictive of these constraints to abide by, thus satisfying all of them. The tracked vehicle that generates the most restrictive constraints may change over time, so the tracking vehicle typically reexamines its constraint options whenever the constraints list is modified.

From the driver's perspective, generalized tracking feels like ordinary tracking: vehicle acceleration appears to be limited by the presence of the vehicle immediately ahead. At times, a preceding vehicle may actually be present, but there could be cases where an empty space in front of tracking vehicle will appear to behave as if a vehicle is there: the empty space will not allow trespass, even though no vehicle is actually there. The vehicle actually being tracked may not be known to the tracking driver, and may even be completely out of that driver's view.

The speed of communication, although normally fast, is constantly factored into the momentary determination of the minimal inter-vehicle gap. Even if communications become slow, there is no danger of collision: the only effect of slow communications is the appearance of larger gaps between vehicles. Of course, the converse is true: inter-vehicle gaps narrow as effective communication rates increase. For example, It is well known in the art of terrestrial radio transmissions that local conditions may produce interference and communication errors. These can be dealt with using known error detection and correction routines. However, such techniques tend to impose increased overhead and computational load, which under some circumstances may slow effective communication.

Moreover, the safety of the vehicular control system is unrelated to the speed with which participating vehicles are moving: their responses are no different from what they would be had all vehicles been traveling in a single lane in the same direction. For example, any vehicle beginning to brake notifies all following vehicles, which then also begin braking. Due to the communication links, the fact that the row is only logical makes no difference. Indeed, safety may be enhanced in many driving situations, due to the superior response time of the automated communication and control devices as compared with human reflexes, and the possibility of inattentiveness on the part of the driver. In any case, a vehicle is prevented from entering the conflict zone until its tracked vehicle has successfully traversed it.

Traversal Order.

In the absence of an automated traffic communication and control system as shown in FIG. 1, the sequence of passage through the conflict zone is generally established on-the-fly by drivers, through watching the traffic and the relevant road signs, and applying traffic rules, such as right-of-way. This procedure suffers from several flaws:

1. All drivers must arrive at the same sequence, or they might run into each other. The danger of collision, as we know, is not theoretical.

2. Computing the sequence takes time, and drivers invariably slow down in the vicinity of conflict zones to give themselves enough time to figure out the correct order. Time and energy are thus wasted when vehicles slow down at a stop sign or a traffic light, and then accelerate when given the right of way. These latencies could be avoided if vehicles were permitted to maintain a constant speed when moving through conflict zones.

3. When an external timing device, e.g., a traffic light, is used to aid the determination, time is wasted when the right of way is given to a direction from which no traffic is coming. Moreover, such timing devices often allow for some dead time when switching directions to reduce the chance of collision. For example, a green light is given in one direction after an interval of "dead time", following actuation of a red light in conflicting directions.

The area control facility 16 determines a sequence in which vehicles traverse a conflict zone, one after the other, referred to as a "traversal order". In one aspect of the invention, the traversal order of vehicles approaching a conflict zone is determined in advance of their arrival, disseminated to the vehicles involved, and enforced by the automated traffic control system. The process eliminates danger of misunderstanding and permits, under normal circumstances, maintenance of a desired vehicle speed of vehicles through the conflict zone and its environs. The time required for slowdown and speedup to permit human decision making is eliminated.

A traversal order of vehicles is a total ordering of all vehicles in the controlled area. Here the term "total ordering" is used in its mathematical sense. A total ordering of vehicles defines unambiguously, for any pair of the vehicles, which of the pair is to be first in traversing the controlled area. Thus, the traversal order is a list of all vehicles that need to cross a particular conflict point in the order they will traverse it.

Adjustments in the operation of individual vehicles, e.g., tracking in order to assure execution of the specified traversal order is normally the responsibility of the communications module 14 and vehicular control module 26 of the individual vehicles, using information supplied by the area control facility 16.

It should be noted that enforcement of a traversal order is different from time scheduling, since only the traversal order of the vehicles is determined, not their arrival times; there is no possibility of a vehicle missing its time slot in this scheme.

Area Control.

Figure 2:
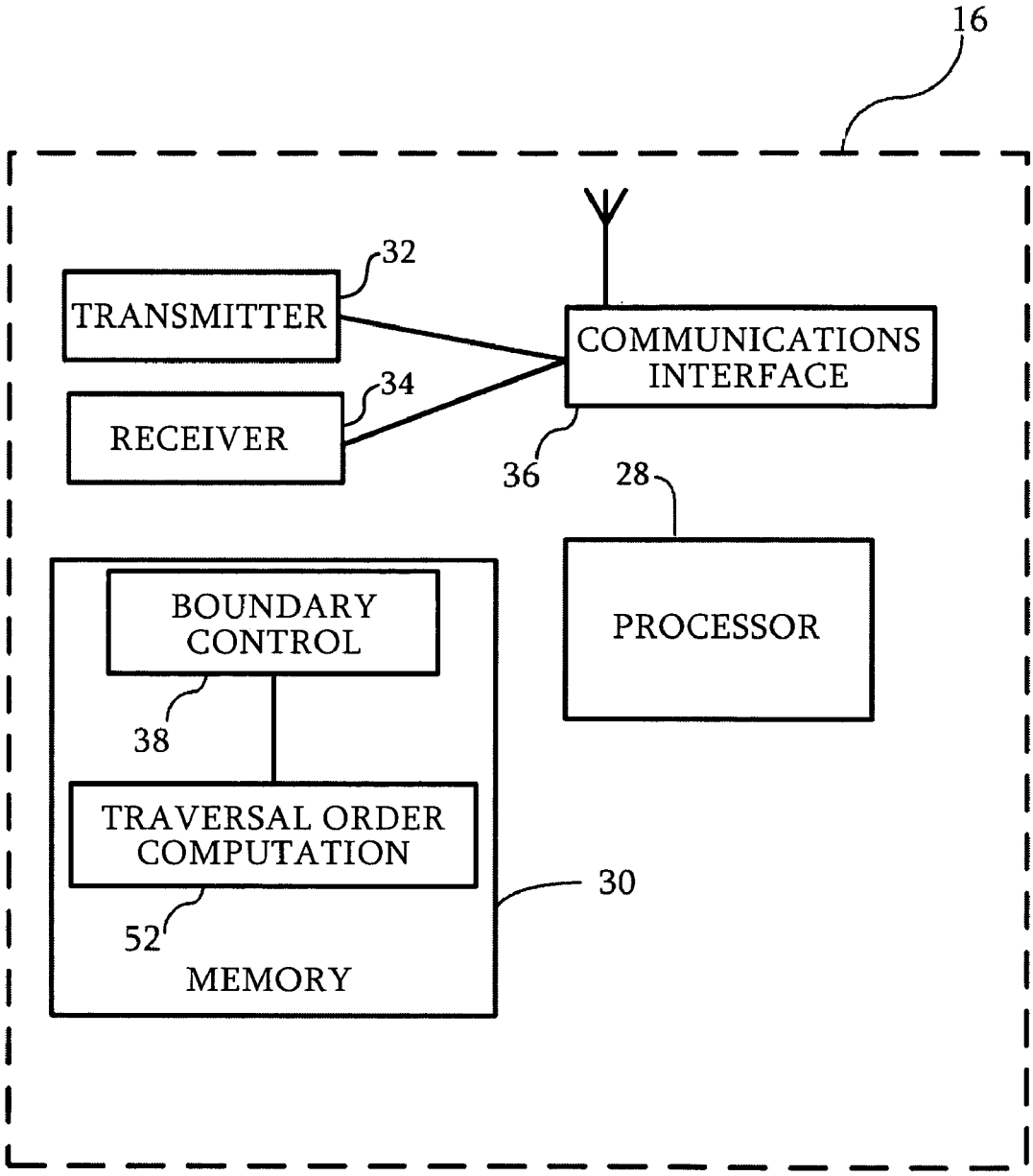
FIG. 2 is a detailed block diagram of the area control facility shown in FIG. 1, in accordance with a disclosed embodiment of the invention.

Reference is now made to FIG. 2, which is a detailed block diagram of the area control facility 16 (FIG. 1), in accordance with a disclosed embodiment of the invention. The area control facility 16 is a hardware device, stationary in most cases, which has jurisdiction over a controlled area, typically including a specific stretch of road. A controlled area may contain several conflict zones. The area control facility 16 includes a processor 28, which may be realized as a general-purpose computer, or a more specialized device, suitably programmed to perform the functions described below. Thus, although portions of the area control facility 16 shown in FIG. 2 and other drawing figures herein are shown as comprising a number of separate functional blocks, these blocks are not necessarily separate physical entities, but rather may represent, for example, different computing tasks or data objects stored in a memory 30 that is accessible to the processor. These tasks may be carried out in software running on a single processor, or on multiple processors. The software may be provided to the processor or processors on tangible media, such as CD-ROM or non-volatile memory. Alternatively or additionally, the area control facility 16 may comprise a digital signal processor or hard-wired logic.

Signals are exchanged between the area control facility 16 and vehicles in the controlled area using a suitable transmitter 32, receiver 34, and a communications interface 36. Many known technologies are suitable for exchange of signals by the vehicles and the area control facility 16: radiofrequency communications, electromagnetic signals in general, optical and infrared transmissions, sound waves, and the like. Mobile transmitters and receivers that are compatible with the transmitter 32 and receiver 34 may be incorporated in the vehicles. Additionally or alternatively, the area control facility 16 may be physically distributed, e.g., having components incorporated in or near the roadway itself. In such case the area control facility 16 is equipped with multiple instances of the transmitter 32, receiver 34, and communications interface 36.

Yet another arrangement may consist of using components on a vehicle passing in the area to carry out the function of the area control facility 16 on a temporary basis, for as long as that vehicle remains in the area. Before leaving, it would transfer its responsibility to some other vehicle now approaching. Clearly, if there are no vehicles in the area to transfer control to, there is no traffic to mange and therefore no need for the services of the area control facility 16 until a vehicle arrives.

A boundary control module 38 defines the boundaries of the controlled area and initiates notification of vehicles as they enter and leave it. In some cases the boundaries are set adaptively, expanding and contracting according to momentary traffic flow and density, as determined by the number of vehicle signatures currently being processed by the processor 28. If the controlled area boundaries are set too narrowly, there might not be enough time for all the vehicles entering the controlled area to establish tracking. On the other hand, boundaries that are set too widely increase the chances that a slow-moving vehicle may enter the controlled area and hold up faster-moving vehicles that have entered later but are now constrained to track it. It is therefore desirable to set the boundaries to encompass as small a controlled area as is practical. To that end, dynamic boundary placement is advantageous compared to static boundaries.

One way to realize a dynamic area control boundary is through the placement of a line, known as the "priority line", across all lanes leading to a common conflict zone generally at the same distance from the conflict zone. Alternatively, under some circumstances, the priority line may be set at a smaller distance from the conflict point on a crowded lane than on a sparsely trafficked lane. Such lanes may or may not be adjacent. Initially, the priority line is set at some minimal distance from the conflict zone, $d_{min}$, but as vehicles pass the line, it is dynamically relocated to expand the controlled area in increments of l, the average space taken up by a vehicle (its physical length plus the current inter-vehicle gap with the preceding vehicle). As vehicles cross the conflict zone and leave the controlled area, the priority line is contracted toward the conflict zone in decrements of l. The priority line is constrained to a maximum distance $d_{max}$ from the conflict zone. While the current inter-vehicle gap is generally a measured distance, which may vary among different types of vehicles, the area control facility 16 uses the momentary average vehicle size and inter-vehicle gap for purposes of establishing the priority line.

Figure 3:
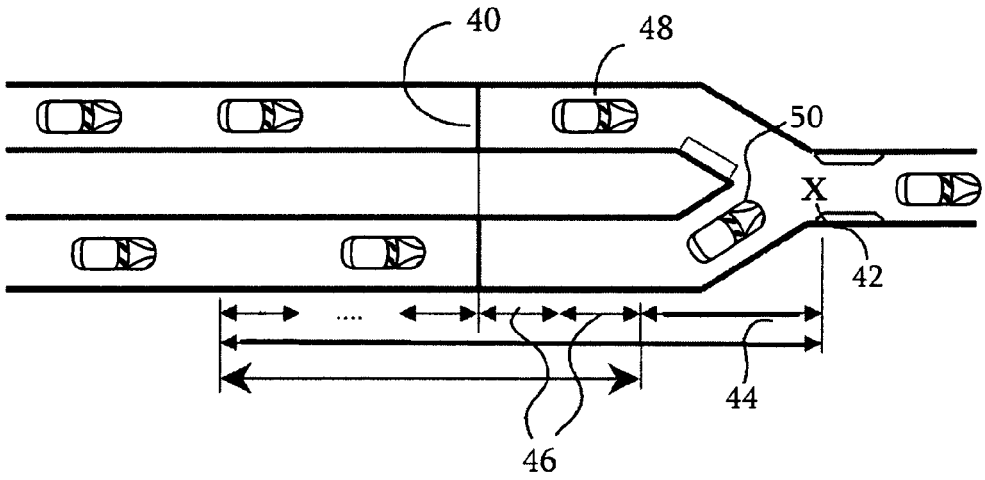
FIG. 3 diagrammatically illustrates details of placement of a priority line, in accordance with a disclosed embodiment of the invention.

Reference is now made to FIG. 3, which diagrammatically illustrates details of placement of a priority line 40 disclosed embodiment of the invention. In one embodiment, assuming there are currently n vehicles between the priority line and the conflict zone, the priority line is set at $$\min(d_{min}+n\times l,\ d_{max}).$$

Distance $d_{min}$ is indicated by an interval 44. Intervals 46 represent the inter-vehicle distance l. It can be seen that the priority line 40 is disposed at a distance $d_{min}+2l$ from the conflict zone 42, as there are two vehicles 48, 50 between the conflict zone 42 and the priority line 40.

Reverting to FIG. 2, the area control facility 16 has the responsibility of maintaining a traversal order, and to indicate to the vehicles their placement in the traversal order. This is accomplished in by cooperation between the boundary control module 38 and a traversal order computation module 52. The boundary control module 38 and traversal order computation module 52 may be implemented in various ways known to the art, e.g., as multiple threads or processes. Alternatively, one or both of the boundary control module 38 and the traversal order computation module 52 may be implemented by specialized hardware.

Vehicles crossing the priority line are assigned monotonically decreasing priority values by the traversal order computation module 52 according the order of their arrival in the controlled area, e.g., region 22 (FIG. 1). In this scheme, a first vehicle referred to herein as being "ahead" of a second vehicle has a lower priority value than that second vehicle. Alternatively, the priority values may be assigned as monotonically increasing values, without loss of generality. Note that a vehicle may be said to cross the priority line due to its own motion, or passively, due to a relocation of the priority line by the boundary control module 38. In either case, priorities are assigned according to the order in which vehicles traverse the priority line. When two or more vehicles are registered as having crossed the priority line simultaneously, or within a short enough time period as to be indistinguishable, one of them is chosen to be first at random. Similar arbitration is employed to assign priority values to the others.

In one outcome, the area control facility 16 orders all vehicles in the order of their arrival, which is assumed to be intuitively fair in the sense that it reasonably correlates with the order at which they would have arrived at the conflict zone. Emergency vehicles, however, could enjoy preferential treatment, by suitable adjustment of the traversal order.

Upon assignment of a vehicle to a traversal order, the area control facility 16 sends a message to the vehicle, identifying the traversal order and the vehicle's position in the traversal order. The message also identifies the vehicle preceding it in the traversal order (or contains a null value if the region 22 is otherwise devoid of traffic). Once assigned to the traversal order, the newly assigned vehicle assumes its role as a tracking vehicle, and begins to track the logically preceding vehicle in the traversal order, applying generalized tracking as described above, eventually traversing the conflict zone immediately following the traversal of the tracked vehicle. Generalized tracking is then discontinued.

Generalized Tracking Operation.

Figure 14:
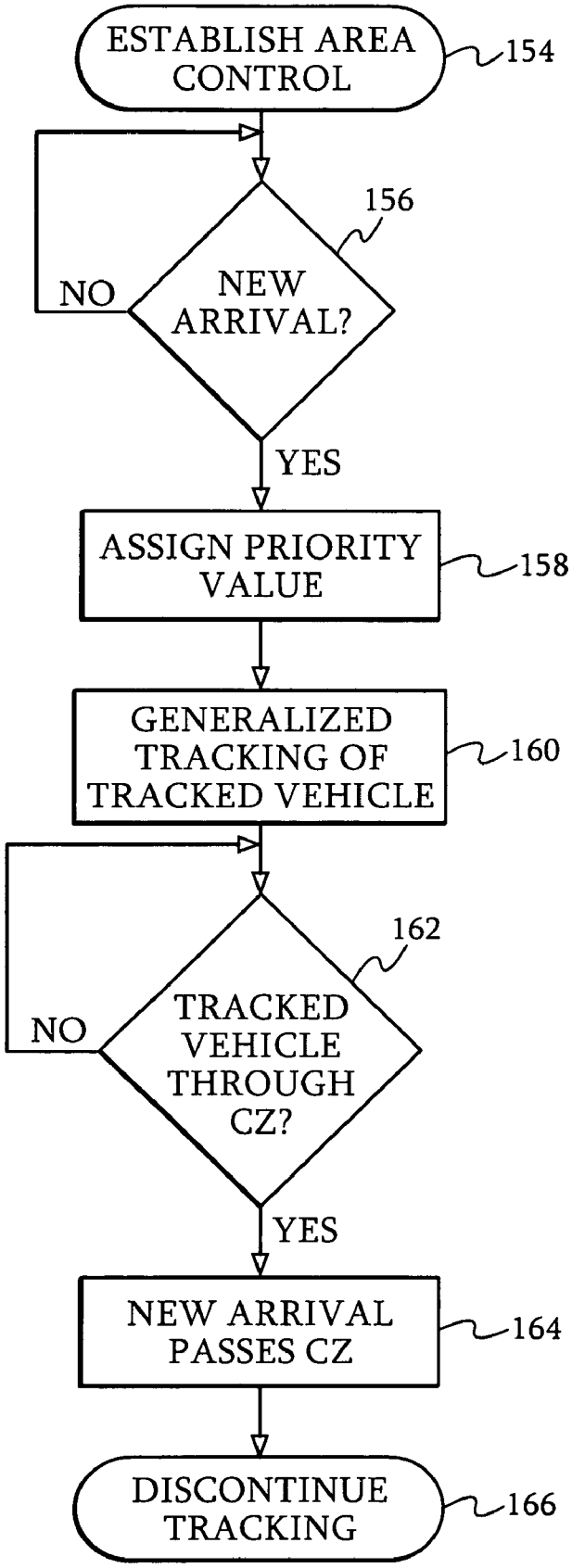
FIG. 14 is a flow chart of a method of automatic vehicular traffic flow control using general tracking, in accordance with a disclosed embodiment of the invention.

Reference is now made to FIG. 14, which is a flow chart of a method of automatic vehicular traffic flow control using generalized tracking, in accordance with a disclosed embodiment of the invention. The following steps are shown in a linear sequence for purposes of explication. However, many of these steps are performed as concurrent instances, in order to handle large numbers of vehicles simultaneously.

At initial step 154, a conflict zone is identified, and an area control facility, e.g., area control facility 16 (FIG. 1) is established with jurisdiction over a controlled area that includes the conflict zone. The integrity of inter-vehicle communications is verified, and communications established between the area control facility and the vehicles within the controlled area. Priority lines are established.

Next, at delay step 156, passage of a new vehicle across the priority line and entry into the controlled area is awaited. It will be recalled that the area control facility 16 can request identification of vehicles within its range of operations, and that vehicles are required to respond. When an arrival is detected, then at step 158 a priority value is assigned to the new arrival, and the vehicle it is to track in the current traversal order, using generalized tracking, is made known to the new arrival.

Next, at step 160, the new arrival begins generalized tracking of its assigned tracked vehicle, while proceeding toward the conflict zone. This continues in delay step 162 until the tracked vehicle passes through the conflict zone (CZ).

Next, at step 164, the new arrival itself passes through the conflict zone.

At final step 166, the new arrival discontinues generalized tracking of its tracked vehicle, and the procedure ends. In some embodiments, however, the tracking vehicle may continue to track the physically preceding vehicle, which in general is not the same vehicle as its previously assigned tracked vehicle. Throughout the procedure, the area control constantly monitors current traffic flow, and may adaptively adjust the position of the priority line.

Speed-Up.

It can be shown that an intersection or other conflict zone must accommodate a flow that is equal to the sum of the incoming flows. Assume that the roads feeding the intersection can, at most, each carry a flow of f vehicles/hour. Assuming that the flow f is equally distributed among all feeders, it can be shown that the intersection itself will need to accommodate 2f vehicles/hour in order to clear this traffic without delay. If the intersection itself has the same properties as the roads leading to it, however, such an intersection could only support a flow of f vehicles/hour. A time division approach (such as used by stop lights) can accommodate one traffic stream while blocking the other completely. Alternatively, it could let 0.5f vehicles/hour pass in each direction, or any other combination, provided the total flow in all directions does not exceed f vehicles/hour. Clearly, if the incoming traffic flow is f in each of two intersecting directions, comprising a total of 2f, only half of that traffic would be able to pass through. A traffic backup would result. The speed-up approach detailed below solves this difficulty. This approach differs from conventional grade separation methods, e.g., construction of overpasses and tunnels, which have been used in the past to eliminate level crossings, but which are often limited by their high cost.

A review of the some definitions and basic relationships will facilitate understanding of some features of the invention.

1. Flow (f) is the number of vehicles crossing a given point in a unit of time, e.g., one hour (h);
2. Density (d) is the number of vehicles per unit distance, e.g., one kilometer (km);
3. Speed (s) is the distance vehicles cover in a unit of time, e.g., kilometers per hour (km/h);
4. Inter-vehicle gap (g) is the space between two consecutive vehicles traveling in the same direction on the same lane.

Then the following two mathematical relations hold:

Flow is proportional to both density and speed. On average:

$$f=d\times s \tag{1}$$

Density and inter-vehicle gap are inversely proportional. In mathematical terms, if the average vehicle length is l, then:

$$g=\frac{1}{d}-l \tag{2}$$

From equation 1 we learn that for a given flow there is a tradeoff between density and speed: density may be reduced if speed is increased without changing the flow. From Equation 2 teaches that reducing density increases inter-vehicle gap. Taken together, we see that by increasing travel speed, inter-vehicle gap may be increased without affecting the overall flow of vehicles.

Figure 4:
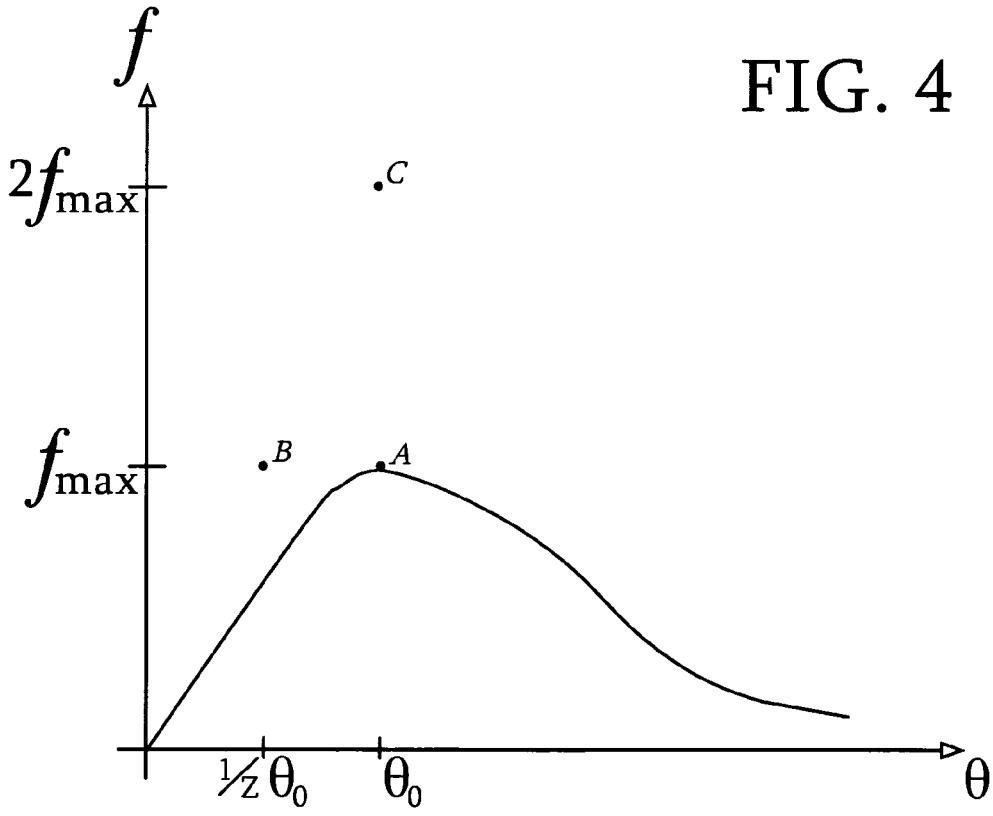
FIG. 4 is a graph illustrating the effects of traffic operations subject to an area control facility, in accordance with a disclosed embodiment of the invention.

Reference is now made to FIG. 4, which is a graph illustrating the effects of traffic operations subject to an area control facility in accordance with a disclosed embodiment of the invention. The graph also illustrates above-described fundamental relationships of traffic flow at uncontrolled intersections, in which traffic flow is plotted against density in intersections. The graph is clearly unimodal. When traffic density is below some threshold $\Theta_0$, flow grows linearly with density. Above that threshold, drivers begin to feel crowded and respond by speed reduction, effectively reducing the flow.

In general, correcting this effect by simply raising the speed of traffic might be difficult and dangerous. However, in an intersection supported by an area control facility, the flow, traffic density, and inter-vehicle gaps can all be controlled by speeding up vehicles from an initial speed of entry into the controlled area to a desired zone speed as they approach the intersection. For example, at a distance from the intersection, traffic flow may be kept constant, at a level indicated by point B in FIG. 4. At the intersection itself, where traffic stream intermix, the flow may double, indicated by point C. The protective tendencies of the human drivers to reduce their speed and thereby impeded traffic flow have been blocked, enabling the traffic to freely flow through an intersection (or other conflict zone), i.e., without backup at zone speeds that are not less than initial speeds of entry into the controlled area. Increased flow in each direction is made possible by employing automatic traffic control, even in the face of high traffic volumes.

Referring again to FIG. 1, embodiments of the invention provide for a localized velocity change within the relatively small controlled region 22. Each vehicle accelerates upon entry to region 22, and then, having crossed the intersection 10, decelerates to its original speed, whereupon it exits region 22. Traffic velocities outside the region 22 remain unchanged as if there were no speed-up. However, within the region 22, inter-vehicle gaps increase, and are maximal at the intersection 10. Moreover, traffic streams interleave at the intersection 10, as described above. As a result of the speed-up, at the intersection 10 itself, larger inter-vehicle gaps permit a greater flow than would otherwise be the case.

Figure 5:
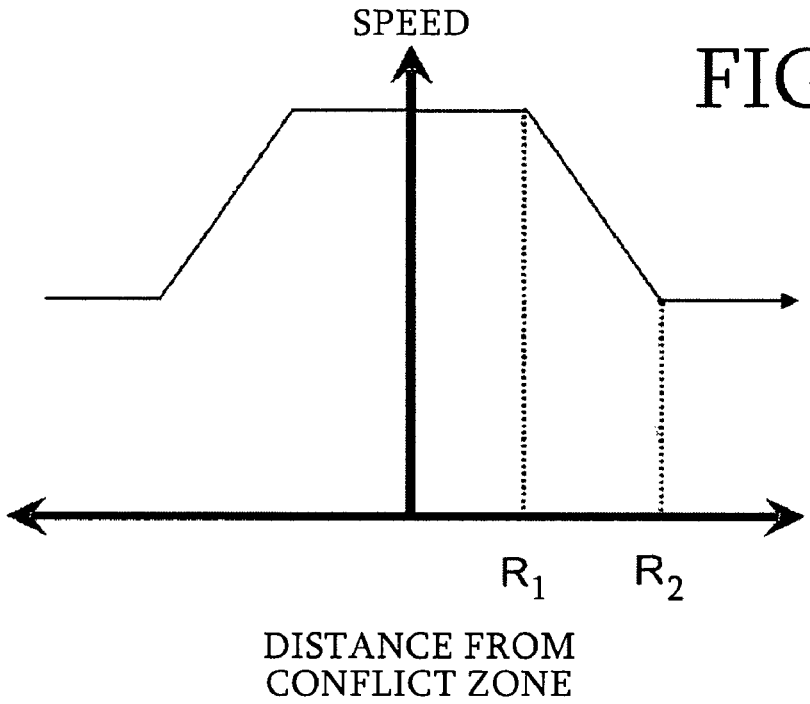
FIG. 5 is a graphical plot of vehicular speed against distance from an intersection, in accordance with a disclosed embodiment of the invention.

Reference is now made to FIG. 5, which is a graphical plot of vehicular speed against distance from an intersection, in accordance with a disclosed embodiment of the invention. It will be apparent from the preceding discussion that, assuming two vehicles move in the same direction and at the same speed, if the gap between them is large enough, a third vehicle moving at a perpendicular direction can cross between them at an intersection without interference. The gap must be at least as large as the sum of the length and the width of the third vehicle.

If convoys of a given maximum length are formed, the vehicular width may be amortized over several vehicles: the inter-convoy gap now must to be at least as large as the sum of the width and the length of the convoy. However as to vehicles comprising a convoy, their inter-vehicle gaps can be made as close to the length of a single vehicle as desired. It is therefore necessary to increase inter-vehicle gaps to a little more than the length of a single vehicle to allow vehicles from the perpendicular direction to flow through without collision, provided the arrival times of vehicles in the two perpendicular directions are synchronized. It will be apparent that if first convoys in a primary direction are larger than second convoys crossing in a secondary direction, then the inter-convoy gaps of the first convoys need only be large enough to accommodate the smaller second convoys. Hence the required speed-up in the two directions could be decidedly different. Of course the smaller convoys would require relatively large inter-convoy gaps in order to interleave with the larger convoys.

Figure 6:
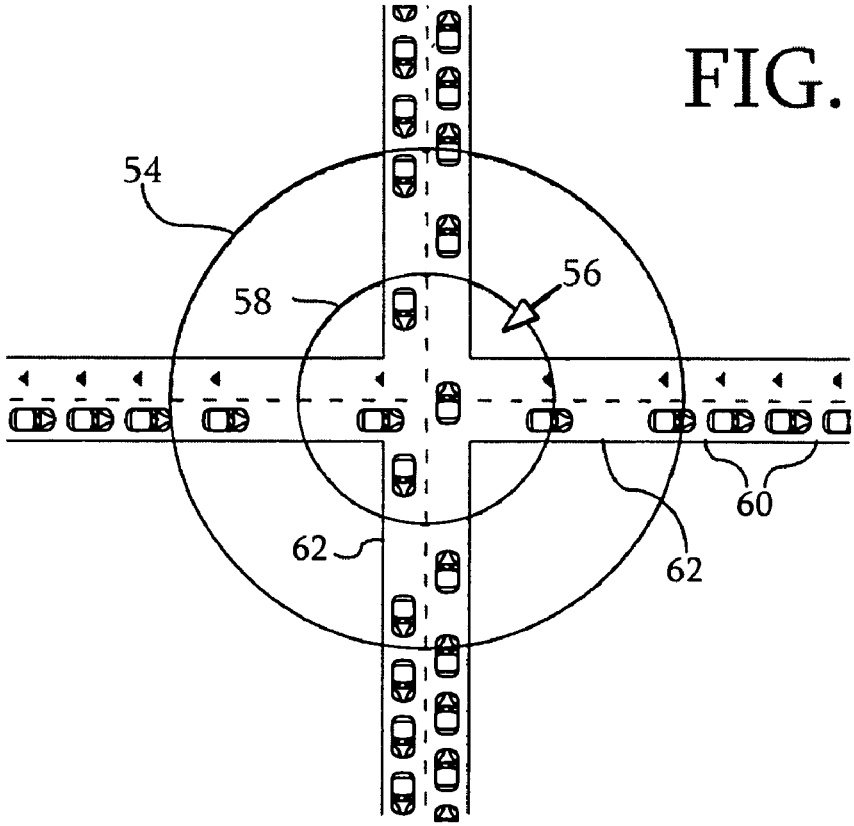
FIG. 6 illustrates automatic traffic control employing speed-up at the intersection that is plotted in FIG. 5, in accordance with a disclosed embodiment of the invention.

Accordingly, priority lines are set, such that vehicles (or convoys) enter a controlled area that is large enough for them to accelerate to the desired speed before reaching the conflict zone. Reference is now made to FIG. 6, which illustrates automatic traffic control employing speed-up at the intersection that is plotted in FIG. 5, in accordance with a disclosed embodiment of the invention. A controlled area is demarcated by an outer circle 54, which is set at a distance from intersection 56 that corresponds to distance R2 on the horizontal axis of FIG. 5. Once each vehicle enters circle 54, it begins to accelerate. Upon reaching inner circle 58, corresponding to distance R1 in FIG. 5, its speed has doubled (assuming flow rates of f in all feeders as described above). From inspection of FIG. 6, it is apparent that outside the circle 54, inter-vehicle gaps 60 are relatively small, as compared with larger inter-vehicle gaps 62 inside circle 54. A symmetric deceleration occurs after passage through intersection 56, beginning as the vehicles exit circle 58. Each vehicle's original speed has been reestablished upon exiting circle 54.

The speed-up scheme essentially is a relationship between speed increment and vehicle position relative to a conflict zone. The term "speed increment" refers to the difference in speed required by a speed-up arrangement and the speed at which that the vehicle would travel were the arrangement not in effect. Parameters of the speed-up scheme are:

1. Distance from the intersection at which acceleration begins.
2. Acceleration rate. It should be noted that acceleration need not be constant, but may vary with distance from the intersection.
3. The maximum speed to be attained.
4. Distance from the intersection at which deceleration begins.
5. Deceleration rate.

A symmetric acceleration and deceleration scheme is depicted in FIG. 5. This is a typical scheme, but under some circumstances the acceleration and deceleration rates may differ.

Speed-Up Management.

Typically, acceleration and deceleration are mediated by the area control facility 16 (FIG. 1). In some embodiments, speed-up is also coordinated with requirements imposed by the generalized tracking scheme described above. In such cases, there may be some lag in achieving the required speeds, due to constraints imposed by generalized tracking. This can be managed by appropriate positioning of the priority line. The position of the priority line correlates with the number of vehicles contained between it and the conflict zone. As noted above, the priority line may be positioned dynamically, according to fluctuations in vehicular traffic density. In general, the frequency at which the priority line is repositioned correlates with the difference between the rate at which vehicles arrive and the rate at which they pass the conflict zone. In the discrete case, the time interval between priority line replacements is inversely proportional to the difference between the incoming and outgoing rates: the shorter the time interval, the more rapidly vehicles should clear the controlled area.

Referring again to FIG. 3, speedup is typically triggered when the priority line reaches the distance of $$(d_{min}+d_{max})/2.$$

For example, the time at which that distance is reached is recorded as time $t_0$. If the priority line is moved upstream at a later time $t_1$, the speed of all vehicles that have crossed the priority line is raised by $l/(t_1-t_0)$. The speed of the vehicles is reduced only when the space between the priority line and the conflict zone is cleared of vehicles.

Speed-Up Operation.

Figure 7:
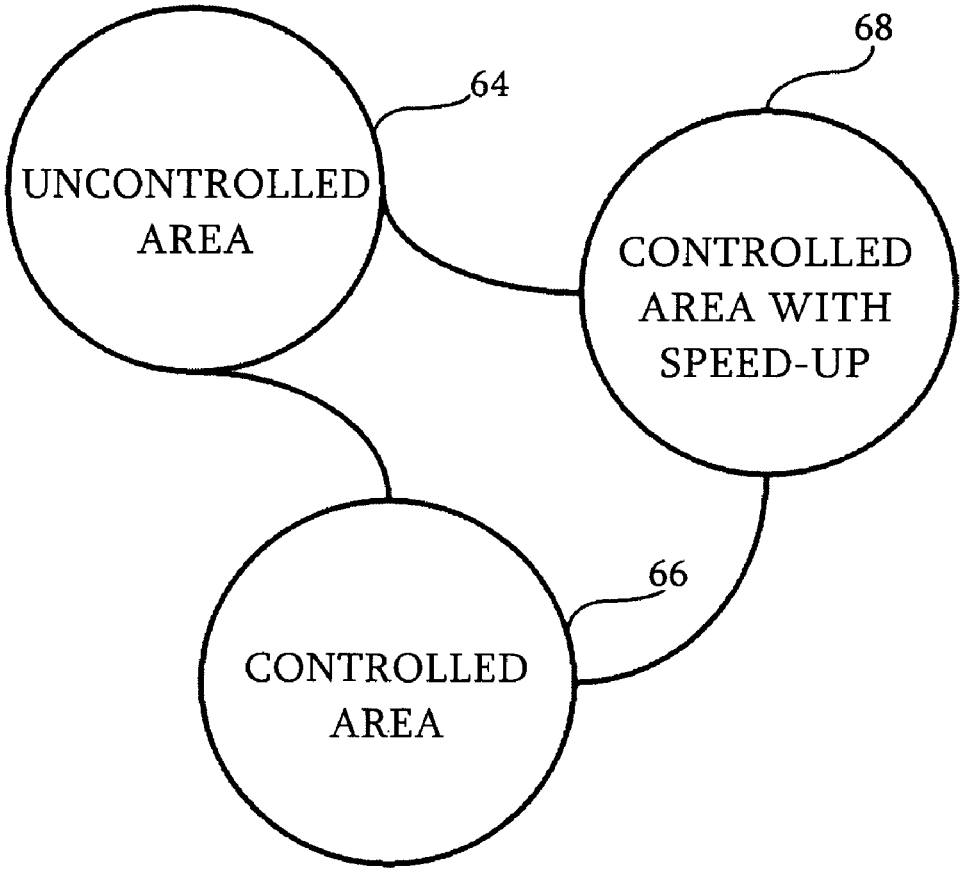
FIG. 7 is a state diagram illustrating vehicular behavior under an automatic traffic control system, in accordance with a disclosed embodiment of the invention.

Vehicles behave differently in non-controlled areas and controlled areas, i.e., areas under the jurisdiction of an area control facility. Furthermore, vehicle behavior in controlled areas that require speed-up is different from that in controlled areas that do not. Reference is now made to FIG. 7, which is a state diagram illustrating vehicular behavior under an automatic traffic control system, in accordance with a disclosed embodiment of the invention. In one state 64, a vehicle is moving in an uncontrolled area. It may operate in ordinary tracking mode, or even under human control.

A transition to a state 66 occurs when a vehicle enters a controlled area. The vehicle is notified by the local area control facility, and switches to generalized tracking mode. The notification includes the identity of the vehicle it should track. A newly entering vehicle in the state 66 not be behind its tracked vehicle, so it may have to slow down, until a proper tracking gap between itself and the tracked vehicle is opened.

A transition may occur from either of the states 64, 66 to a third state 68, in which the vehicle is operating in a controlled area in which speed-up is in effect. In a control area employing speed-up, the area control facility conveys to an entering vehicle, in addition to the information required by state 66, the parameters of the speed-up scheme. The vehicle uses the scheme and its own position information to continuously calculate a momentary speed increment. It then does its best to implement the speed increment, subject to tracking constraints and the capabilities of its power train.

Reference is now made to FIG. 8, which is a flow chart of a method of automatic traffic control employing speed-up, in accordance with a disclosed embodiment of the invention.

At initial step 70, a conflict zone is identified, and an area control facility, e.g., area control facility 16 (FIG. 1) is established with jurisdiction over a controlled area that includes the conflict zone. The integrity of inter-vehicle communications is verified, and communications established between the area control facility and the vehicles within the controlled area. Priority lines are established. The following process steps are shown in a particular linear sequence in FIG. 7 for clarity of presentation. However, it will be evident that some of them can be performed in parallel, asynchronously, or in different orders.

Next, at step 72, traffic density is determined in each traffic stream flowing through the conflict zone. The measured densities are used to determine speed-up parameters, which is accomplished in step 74.

Next, at step 76 a traversal order for passage of the traffic streams through the conflict zone is computed.

At final step 78 speed-up parameters and tracking information necessary to effect the computed traversal order are communicated to vehicles in the controlled area. The procedure terminates. In practice, the procedure is iterated, either continuously, or upon detection of a new arrival in the controlled area.

Scenarios.

In the following scenarios, it is assumed that an area control facility is operating over a controlled area that includes the conflict zone.

Scenario 1: A Blocked Lane in a Multi-Lane Highway.

Reference is now made to FIG. 9, which diagrammatically illustrates automatic traffic control in a multi-lane highway in which some of the lanes are blocked in accordance with a disclosed embodiment of the invention. As is well known to contemporary drivers, such blockages are common, and can result from disabled vehicles or roadwork. In any event, the space in the unblocked lane next to a blockage 80, through which traffic arriving on the blocked lane will eventually have to travel, constitutes a conflict zone 82. Of course, if there are multiple unblocked lanes, each may have its own conflict zone. It is assumed that the controlled area extends from the blockage 80 to a priority line 84, which may be dynamically set as described above.

Vehicles that have crossed the priority line 84 and are within the controlled area are assigned priorities, such that vehicles having high priorities enter the conflict zone before vehicles with low priorities. The metrics for generalized tracking in this case is simply the distance to the blockage. Prioritized vehicles begin following all vehicles with a higher priority than their own, regardless of their respective lane position. This causes vehicles to arrange themselves such that overlaps, indicated by a broken ellipse 86, disappear, and are replaced by non-overlapped configurations as indicated by a broken ellipse 88, even if neighboring vehicles are travelling in different lanes, as shown by a broken ellipse 90. Once that state has been reached, any vehicle in blocked lane 92 may move to unblocked lane 94 with confidence, knowing that all vehicles in the unblocked lane 94 with lower priority are already tracking its position. As a result, a gap for the lane-changing vehicle is guaranteed.

Reference is now made to FIG. 10, which diagrammatically shows a sequence of vehicular realignments that occur in the blocked multi-lane highway shown in FIG. 9, in accordance with a disclosed embodiment of the invention. In a first frame 96, vehicles are approaching a priority line 98 in an alignment dictated only by the judgment of individual drivers. A relatively small inter-vehicle distance separates vehicles 100, 102.

In a second frame 104, the vehicles have passed the priority line 98 and have established generalized tracking. Now vehicles 100, 102 are separated by a relatively large gap in order to accommodate insertion of vehicle 106. This has occurred in a third frame 108 as a result of lane changing by the vehicle 106. All the vehicles are now proceeding in single file in an unblocked lane.

In some embodiments, lane changing remains the responsibility of the driver, generalized tracking only modulating vehicle speed, but not steering. The driver then becomes responsible to complete a change of lanes during an interval beginning when his vehicle crosses the priority line 84 and ending immediately prior to reaching the blockage 80. Vehicles that fail to move to the open lane during this interval themselves become blocked, and have to wait until traffic in the other lane has subsided. Driver errors of this nature extend the scope of the blockage 80, and may require adjustments in the position of the priority line 84 by the area control facility. In other embodiments, the automated traffic control system may also control steering in addition to tracking, in which case the noted driver errors are entirely avoided.

Scenario 2: Intersection where no Turns are Allowed.

Reference is now made to FIG. 11, which diagrammatically illustrates automatic traffic control in an intersection 110 in accordance with a disclosed embodiment of the invention. No turns are allowed in the intersection 110: all vehicles are constrained to cross the intersection going straight only. While single one-way lanes are shown entering the intersection 110 in FIG. 10 for simplicity of presentation, it will be apparent from scenarios presented hereinbelow that the principles applied in this scenario are applicable, mutatis mutandis, to multi-lane intersections. The two lanes form exactly one conflict zone 112: the area common to the two lanes. The bounds of the controlled area are set by priority lines 114, 116, which are placed, possibly dynamically, on both incoming lanes, generally, but not necessarily, at equal distances from the conflict zone 112.

Generalized tracking is performed by the vehicles in the controlled area, using the following metrics:

1. The distance between two vehicles traveling in the same lane is the distance one must travel in order to touch the end of the other.

2. The distance between two vehicles approaching the intersection on different roads is defined as the difference between their respective distances to the part of the CP that is closest to each. For example, the inter-vehicle distance between vehicle 118 and vehicle 120, which is physically ahead of vehicle 118, is given by:

$$d_{31}=d_3-d_1-l$$

where l is the average length of a vehicle. The distance between vehicle 122 and vehicle 120, approaching the conflict zone 112 from different directions, is given by:

$$d_{21}=d_2-d_1-\lambda-w$$

where w is a padding value, which in this scenario happens to be about the maximum width of a vehicle. The padding value w is needed because the distance a vehicle travels from the point it enters the conflict zone to the point it clears it is the sum of the length of the vehicle and the width of the conflict zone. However, from the geometry of the intersection, a conflict zone should be wide enough to accommodate the widest vehicle, and should not be much more than that.

Figure 12:
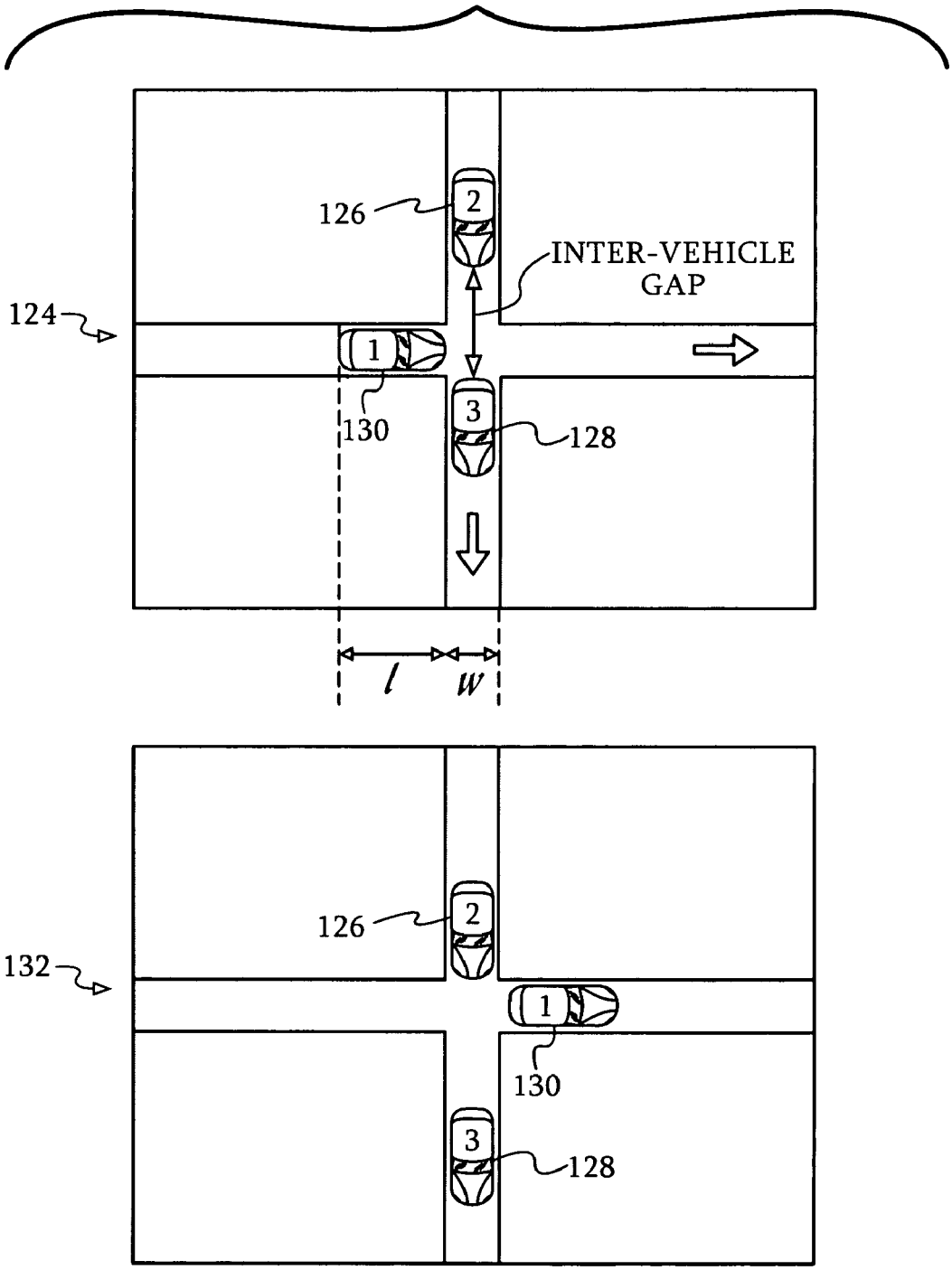
FIG. 12 diagrammatically illustrates assignment of inter-vehicle distance, in accordance with a disclosed embodiment of the invention.

A vehicle crossing an intersecting traffic stream needs a gap at least as wide as its length plus its width. Reference is now made to FIG. 12, which diagrammatically illustrates the assignment of inter-vehicle distance at an intersection, in accordance with a disclosed embodiment of the invention. In frame 124, a vehicle 126 is tracking a preceding vehicle 128. A vehicle 130 is approaching the intersection perpendicular to the vehicles 126, 128. The distance that the vehicle 130 travels between its entrance into the intersection in frame 124 until it clears the intersection, as shown in frame 132, is l+w. Assuming vehicles 126, 128, 130 all move at the same speed, the inter-vehicle gap between vehicles 126, 128 must also be set at l+w, in order for vehicle 126 to avoid vehicle 130.

Figure 13:
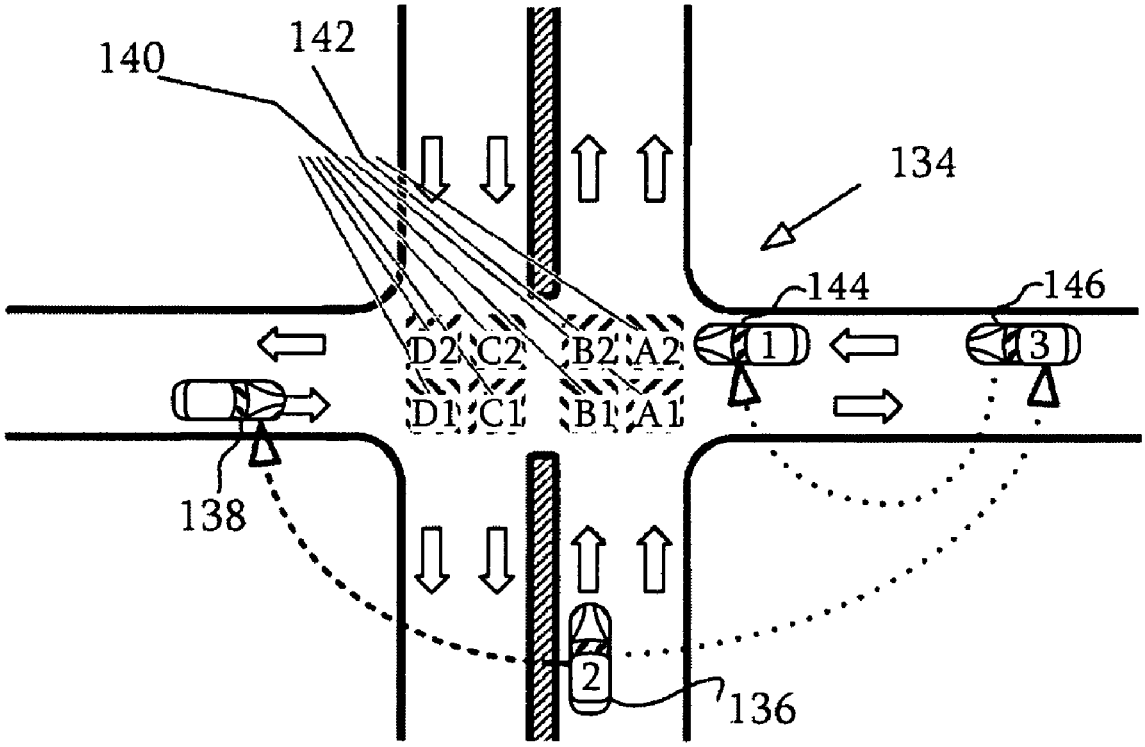
FIG. 13 diagrammatically illustrates automatic traffic control in a complex intersection, in accordance with a disclosed embodiment of the invention.

The above-described principles are applicable to intersections having any number of intersecting lanes, assuming no turning is allowed. Each area common to two intersecting lanes is considered to be a conflict zone, and a separate priority line is maintained for each such conflict zone. Reference is now made to FIG. 13, which diagrammatically illustrates automatic traffic control in a complex intersection 134 in accordance with a disclosed embodiment of the invention. There are eight conflict zones in this example, shown in hatched patterns. One or more area control facilities are provided to maintain individual traversal orders for each of the conflict zones. Some traffic streams are omitted for clarity of presentation. Each vehicle is informed of the conflict zones it must cross, and which vehicle has the next higher priority value, i.e., is logically just ahead of it, in each of the associated traversal orders. Thus in FIG. 12, a vehicle 136 would cross two conflict zones, while a vehicle 138 would cross four conflict zones. The vehicle 138 would track four other vehicles simultaneously, using the method of generalized tracking described above. Each of the four tracked vehicles imposes some distance from the intersection that the vehicle 138 must maintain at any given moment. The maximum of these distances satisfies the tracking requirements of all of four traversal orders, and that is the distance the vehicle 138 should maintain. The constraints on the vehicle 136 are less rigorous, as it only need maintain the maximum distance from the intersection imposed by two tracked vehicles.

Regarding the traversal orders, vehicle 136 must cross conflict zones 140, 142, in order to traverse the intersection. The traversal order for conflict zone 140 includes vehicle 138, and that of conflict zone 142 includes vehicles 144, 146. Vehicles 144, 146 should both pass through the intersection before vehicle 136. Although the speeds of the vehicles in FIG. 12 are not known, it may be assumed that the speeds are comparable, and that vehicle 136 follows vehicle 138. Vehicle 136 also follows vehicle 144, since vehicle 144 is even closer to its conflict zone with vehicle 136 than is vehicle 138. A likely traversal order through the intersection 134 is: [1] vehicle 144; [2] vehicle 146; [3] vehicle 138; [4] vehicle 136. Vehicle 146 would track vehicle 144, which reduces to ordinary tracking, as both are traveling in the same lane, and one immediately precedes the other. It should be noted that vehicle 136 would be assigned to track both vehicle 138 and vehicle 146. The latter vehicles are approaching the intersection in different directions from vehicle 136, thereby requiring application of generalized tracking. It may be noted that the driver of vehicle 136 might not even be aware of the presence of one or more of vehicles 138, 146. Vehicle 138, being the first vehicle to enter the intersection 134, has no tracking responsibilities. In FIG. 12, broken curved lines illustrate the respective tracking responsibilities of the various vehicles.

Some constraints described in Scenarios 1 and 2 may be relaxed. For example, right hand turns may be accommodated by simply providing additional turning lanes (not shown). In some embodiments, vehicles may be controlled so as to all approach the area of the intersection at a predetermined speed. A spatial buffer around the conflict zone may be defined, and used to adjust arrival speed so that at the conflict zone all vehicles are traveling at the same speed. Doing so makes inter-vehicle gaps a fixed distance, thus simplifying the calculations required of the control center.

Platooning.

Vehicles of various dimensions may be accommodated if convoys are assembled and treated as units. Convoy length can be set at some fixed value, e.g., the length of two semi-trailers, and could contain any combination of vehicles up to that value, with adaptations for smaller convoys when traffic becomes sparse. A convoy need not be full, in the sense of containing a predetermined number of vehicles or having a predetermined length: if a convoy being staged lacks sufficient room to include the next vehicle in line, it may be sent on its way and a new one established. The convoy is permitted to disassemble once the conflict zone has been passed.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art, which would occur to persons skilled in the art upon reading the foregoing description.

The invention claimed is:

1. A method of automatic vehicular traffic flow control, comprising the steps of:

defining a controlled area that includes a conflict zone having a plurality of vehicular traffic streams passing therethrough in different directions and entering the controlled area at respective initial speeds, wherein vehicles belonging to different ones of the vehicular traffic streams contend for occupancy of the conflict zone; and interleaving the vehicular traffic streams at the conflict zone under automatic control while varying respective zone speeds of the vehicular traffic streams such that the vehicular traffic streams freely flow through the conflict zone without traffic backup, wherein the zone speeds are not less than the respective initial speeds.

2. The method according to claim 1, wherein varying respective zone speeds comprises accelerating the vehicles prior to reaching the conflict zone and decelerating the vehicles subsequent to passage therethrough.

3. The method according to claim 2, wherein accelerating and decelerating the vehicles cause the vehicles to exit the controlled area at the respective initial speeds.

4. The method according to claim 1, wherein varying respective zone speeds comprises adjusting the zone speeds of the vehicular traffic streams so as to achieve a desired throughput through the conflict zone.

5. The method according to claim 1, wherein varying respective zone speeds comprises adjusting the zone speeds of the vehicular traffic streams so as to achieve desired respective inter-vehicle gaps in the vehicular traffic streams at the conflict zone.

6. The method according to claim 1, further comprising the steps of dynamically adjusting a size of the controlled area responsively to a momentary density of the vehicular traffic streams to accommodate a desired scheme of acceleration and deceleration of the vehicular traffic streams.

7. The method according to claim 1, further comprising the steps of:

computing a traversal order for the vehicles that are located within the controlled area to define ordered vehicles; and causing the ordered vehicles to traverse the conflict zone sequentially in accordance with their respective positions in the traversal order.

8. The method according to claim 1, wherein interleaving the vehicular traffic streams comprises forming convoys within the streams and interleaving the convoys.

9. A computer software product for use in automatic vehicular traffic flow control, including a computer storage medium in which computer program instructions are stored, which instructions, when executed by a computer, cause the computer to define a controlled area that includes a conflict zone having a plurality of vehicular traffic streams passing therethrough in different directions and entering the controlled area at respective initial speeds, wherein vehicles belonging to different ones of the streams contend for occupancy of the conflict zone, interleave the vehicular traffic streams at the conflict zone while varying respective zone speeds of the vehicular traffic streams such that the vehicular traffic streams freely flow through the conflict zone without traffic backup, wherein the zone speeds are not less than the respective initial speeds.

10. The computer software product according to claim 9, wherein the computer is instructed to issue command signals that cause the vehicles to accelerate prior to reaching the conflict zone and decelerate the vehicles subsequent to passage therethrough.

11. The computer software product according to claim 10, wherein the command signals cause the vehicles to exit the controlled area at the respective initial speeds.

12. The computer software product according to claim 10, wherein the command signals control the zone speeds of the vehicular traffic streams so as to achieve a desired throughput through the conflict zone.

13. The computer software product according to claim 10, wherein the command signals control the zone speeds of the vehicular traffic streams so as to achieve desired respective inter-vehicle gaps in the vehicular traffic streams at the conflict zone.

14. The computer software product according to claim 9, wherein the computer is further instructed to dynamically adjust a size of the controlled area responsively to a momentary density of the vehicular traffic streams to accommodate a desired scheme of acceleration and deceleration of the vehicular traffic streams.

15. A traffic control system for automatic vehicular traffic flow control, comprising:

a transmitter;

a receiver;

an area processor for controlling a plurality of vehicular traffic streams passing through a conflict zone in different directions, wherein vehicles belonging to different ones of the streams contend for occupancy of the conflict zone; and a memory, accessible to the processor, storing program instructions, which instructions, when executed by the processor, cause the processor to define a controlled area that includes the conflict zone, wherein the vehicular traffic streams enter the controlled area at respective initial speeds, and wherein the processor is operative to control the vehicular traffic streams so as to interleave the vehicular traffic streams at the conflict zone; and issue command signals, causing the vehicles to vary respective zone speeds such that the vehicular traffic streams freely flow through the conflict zone without traffic backup and wherein the zone speeds are not less than the respective initial speeds.

16. The traffic control system according to claim 15, wherein the command signals accelerate the vehicles prior to reaching the conflict zone and decelerate the vehicles subsequent to passage therethrough.

17. The traffic control system according to claim 16, wherein the command signals cause the vehicles to exit the controlled area at the respective initial speeds.

18. The traffic control system according to claim 15, wherein the command signals control the zone speeds of the vehicular traffic streams so as to achieve a desired throughput through the conflict zone.

19. The traffic control system according to claim 15, wherein the command signals control the zone speeds of the vehicular traffic streams so as to achieve desired respective inter-vehicle gaps in the vehicular traffic streams at the conflict zone.

20. The traffic control system according to claim 15, wherein the instructions further cause the processor to dynamically adjust a size of the controlled area responsively to a momentary density of the vehicular traffic streams to accommodate a desired scheme of acceleration and deceleration of the vehicular traffic streams.

21. A method of automatic vehicular traffic flow control, comprising the steps of:

defining a controlled area that includes a conflict zone having a plurality of vehicular traffic streams passing therethrough, including a first stream and a second stream, wherein vehicles belonging to different ones of the streams contend for occupancy of the conflict zone;

computing a traversal order for the vehicles that are located within the controlled area to define ordered vehicles, wherein the ordered vehicles are assigned to traverse the conflict zone sequentially in accordance with their respective positions in the traversal order, designating, among the ordered vehicles, tracking vehicles and a respective tracked vehicle for each of the tracking vehicles, wherein the respective tracked vehicle immediately precedes each of the tracking vehicles in the traversal order, and wherein at least a portion of the tracking vehicles belong to the first stream and their respective tracked vehicles belong to the second stream; and causing each of the tracking vehicles to maintain a specified physical relationship with the respective tracked vehicle thereof, until the respective tracked vehicle has traversed the conflict zone.

22. The method according to claim 21, wherein the traversal order is a total ordering, which defines unambiguously, for any pair of the vehicles, which of the pair is to be first in traversing the conflict zone.

23. The method according to claim 21, further comprising the step of preventing the tracking vehicles from entering the conflict zone until their respective tracked vehicles have crossed the conflict zone.

24. The method according to claim 21, wherein the specified physical relationship is a function of distances to the conflict zone of the tracking vehicles and their respective tracked vehicles.

25. The method according to claim 21, wherein the tracking vehicles and their respective tracked vehicles approach the conflict zone from different directions.

26. The method according to claim 21, further comprising maintaining a constant speed of the streams through the conflict zone.

27. The method according to claim 21, further comprising the step of: adjusting boundaries of the controlled area responsively to a momentary traffic density in the streams.

28. A computer software product for automatic vehicular traffic flow control, including a computer storage medium in which computer program instructions are stored, which instructions, when executed by a computer, cause the computer to define a controlled area that includes a conflict zone, monitor a plurality of vehicular traffic streams passing through the conflict zone, including a first stream and a second stream, wherein vehicles belonging to different ones of the streams contend for occupancy of the conflict zone, compute a traversal order for the vehicles that are located within the controlled area to define ordered vehicles, wherein the ordered vehicles are assigned to traverse the conflict zone sequentially in accordance with their respective positions in the traversal order, designate, among the ordered vehicles, tracking vehicles and a respective tracked vehicle for each of the tracking vehicles, wherein the respective tracked vehicle immediately precedes each of the tracking vehicles in the traversal order, and wherein at least a portion of the tracking vehicles belong to the first stream and their respective tracked vehicles belong to the second stream, and cause each of the tracking vehicles to maintain a specified physical relationship with the respective tracked vehicle thereof, until the respective tracked vehicle has traversed the conflict zone.

29. A traffic control system for automatic vehicular traffic flow control, comprising:

a transmitter;

a receiver;

an area processor for controlling a plurality of vehicular traffic streams passing through a conflict zone, including a first stream and a second stream, wherein vehicles belonging to different ones of the streams contend for occupancy of the conflict zone; and a memory, accessible to the processor, storing program instructions, which instructions, when executed by the processor, cause the processor to define a controlled area that includes the conflict zone, to receive messages via the receiver from tracking vehicles in the streams that are passing through the controlled area, the messages comprising location information of the respective tracking vehicles, compute a traversal order for the tracking vehicles to traverse the conflict zone sequentially in accordance with their respective positions in the traversal order, and to transmit control signals via the transmitter, wherein the control signals cause the tracking vehicles to maintain a specified physical relationship with respective tracked vehicles until the tracked vehicles traverse the conflict zone, wherein the tracked vehicles immediately precede the tracking vehicles in the traversal order, respectively, and wherein at least a portion of the tracking vehicles belong to the first stream and their respective tracked vehicles belong to the second stream.

* * * * *